United States Patent [19]

Assini et al.

[11] Patent Number: 4,679,883

[45] Date of Patent: Jul. 14, 1987

[54] SHOULDER EYELET BOARD LOCK

[75] Inventors: John E. Assini; Paula A. Kissinger, both of Harrisburg, Pa.

[73] Assignee: AMP Incorporated, Harrisburg, Pa.

[21] Appl. No.: 904,315

[22] Filed: Sep. 8, 1986

[51] Int. Cl.[4] ..... H01R 4/66; H01R 13/648

[52] U.S. Cl. ..... 439/607; 439/95; 439/83; 439/573

[58] Field of Search ..... 339/14 R, 17 LC, 125 R, 339/126 R, 143 R

[56] References Cited

U.S. PATENT DOCUMENTS 3,092,175 6/1963 Suessle ..... 160/390

4,506,937 3/1985 Cosmos et al. ..... 339/14 R 4,512,618 4/1985 Kumar ..... 339/143 R X 4,518,209 5/1985 Negley ..... 339/143 R X

*Primary Examiner*—Eugene F. Desmond

*Attorney, Agent, or Firm*—David L. Smith

[57] ABSTRACT

An electrical connector assembly having an eyelet disposed in an opening in the mounting flange of the connector housing has a rivet frictionally secured within the eyelet. The rivet has a flange engaging an upper section of the eyelet, a first section engaging the eyelet in an interference fit and a second section extending below a bottom surface of the connector housing for disposition in a hole in a printed circuit board.

7 Claims, 7 Drawing Figures

SHOULDER EYELET BOARD LOCK

BACKGROUND OF THE INVENTION

This invention relates to an electrical connector assembly and in particular to an electrical connector assembly having integral means for securing the assembly to a printed circuit board.

Techniques exist for providing electrical connectors with integral means for being secured to a printed circuit board. One such prior art technique is disclosed in copending U.S. patent application Ser. No. 786,456 filed Oct. 11, 1985 assigned to the same assignee as the present application, in which drawn rivets each having a flange, a tubular shank and a generally conical closed end tapering from the shank to a tip remote therefrom are utilized. The shank has elongate slots therein which are generally parallel to the axis of the shank, each rivet being received in a hole through a respective flange and subjected to axial compression so that the slots open and the shank expands radially between the mounting face and the closed end. When the connector is assembled to a printed circuit board, the expanded portion of each shank compresses radially to comply to the printed circuit board hole and provides retention until contacts in the connector are soldered to the printed circuit board.

Another technique is disclosed in U.S. Pat. No. 4,512,618 wherein holes in the ground strap have a plurality of inwardly directed tines in wiping engagement with the mounting hardware. The tines retain the mounting hardware as part of the connector assembly until the connector is secured to a printed circuit board whereupon the tines continue to function as an electrical path between the ground strap and the mounting hardware.

While each of the above techniques provides a satisfactory integral means for being secured to a printed circuit board, the former requires axial compression of the rivet after insertion and the latter requires a special metal shield in which the group strap holes have inwardly directed tines. The present invention dispenses with special requirements of the prior art techniques and provides an electrical connector assembly with integral means for securing the assembly to a printed circuit board that can be fabricated from a standard, stocked electrical connector. Upon receipt of an order, a stock item could be modified to include the integral securing means rather than stock two assemblies.

SUMMARY OF THE INVENTION

In accordance with the invention, an electrical connector for mounting to a printed circuit board includes an elongate dielectric housing having flanges at opposite ends thereof, the flanges have coplanar mounting surfaces received against the printed circuit board with each mounting surface having an opposed holding face. Each flange has a hole therethrough which is aligned with a respective hole in the printed circuit board. A formed eyelet with end flanges engaging the mounting face and the holding face and having a generally cylindrical shank extending therebetween is closely received in the hole. A shoulder eyelet having a flange and generally tubular shank is closely received in the formed eyelet. The tubular shank of the rivet is mounted with the flange adjacent the holding face and the shank extending beyond the mounting face. The shoulder eyelets are frictionally disposed in the formed eyelets with an interference fit therebetween. The shoulder eyelets align with respective preformed holes in the printed circuit board for securing the electrical connector thereto.

With the connector assembly received on the printed circuit board for being secured thereto, the ends of the shanks of the shoulder eyelets extend into preformed holes in the printed circuit board thence beyond the printed circuit board. The shoulder eyelet shank ends may be flange coiled or wave soldered to secure the connector assembly to the printed circuit board.

DESCRIPTION OF THE PREFERRED EMBODIMENT

Figure 1:
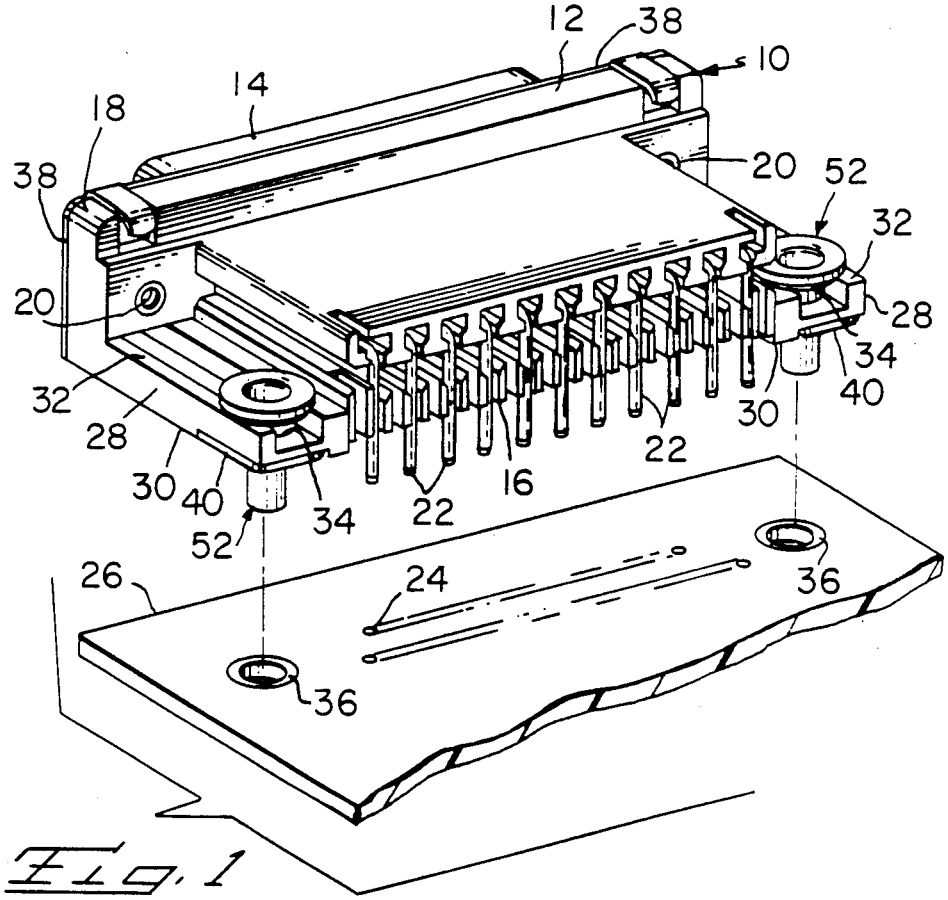
FIG. 1 is a perspective view of a connector assembly in accordance with the present invention, exploded from a printed circuit board.

Referring to the Drawings, initially to FIG. 1, there is depicted therein an electrical connector assembly in accordance with the present invention. An exemplary right angle connector 10 comprises a housing 12 molded of thermoplastic and having a mating face 14 at a right angle with respect to bottom face 16. Mating face 14 is surrounded by flange 18 having holes 20 at opposite ends thereof for securing a complementary connector thereto. Bottom face 16 has solder tails 22 extending therefrom for reception in plated through holes 24 in printed circuit board 26.

Bottom face 16 of connector 10 has integral flanges 28 at opposite ends thereof. Each flange 28 has a coplanar mounting face 30 which is received against printed circuit board 26, an opposed holding face 32 with hole 34 extending therebetween. Holes 34 in housing 12 have the same spacing as corresponding holes 36 in printed circuit board 26 on which connector 10 is to be mounted.

A formed metal shield 38 on mating face 14 has integral ground straps 40 extending to respective mounting faces 30. Ground straps 40 are secured to respective mounting faces 30 by eyelets 42 received in holes 34 in flanges 28. Eyelets 42 have first end flange means 44 that engage holding face 32 and second end flange means 46 that engage mounting face 30, or if present ground strap 40. Eyelets 42 have a generally cylindrical shank 48 extending between end flange means 44 and 46 that fits loosely within holes 34 as the inside diameter of hole 34 is slightly greater than the outside diameter of eyelet 42. The interior of shank 48 defines hole 50 which receives rivet 52.

Rivet 52 has a generally tubular shank 54 disposed in hole 50 of eyelet 42. Rivet 52 has flange means 56 which engages flange means 44 of eyelet 42, a first section 58 within eyelet 42 and a second section 60 extending beyond first section 58 and beyond mounting face 30 to pass through holes 36 in printed circuit board 26.

Figure 2:
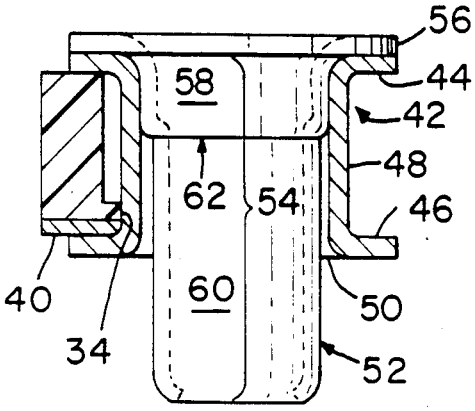
FIG. 2 is a partial cross-section of a mounting flange showing a shoulder eyelet disposed in a coaxial eyelet.
Figure 3:
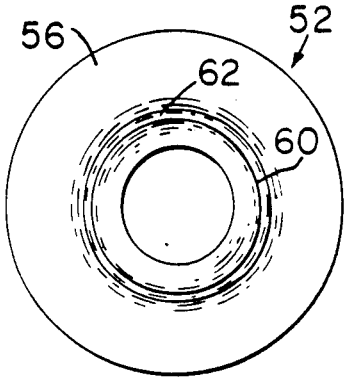
FIG. 3 is a bottom end view of the shoulder eyelet of FIG. 3.

FIG. 2 shows rivet 52 disposed in eyelet 42. FIG. 3 shows a bottom view of rivet 52. First section 58 of shank 54 has a diameter to provide an interference fit between first section 58 of rivet 52 and eyelet 42. The interference fit between first section 58 of rivet 52 and eyelet 42 does not place undue stress onto flanges 28 at the location of holes 34 because eyelet 42 absorb such stress. Second section 60 of shank 48 is remote from flange means 56 and typically has a smaller diameter than first section 58 with the diameter of second section 60 being less than by the diameter of holes 36. Shoulder 62 forms the transition between the diameter of first section 58 and the diameter of second section 60. Shoulder 62 is typically within eyelet 42 so as not to interfere with mounting housing 12 on printed circuit board 26.

Figure 4:
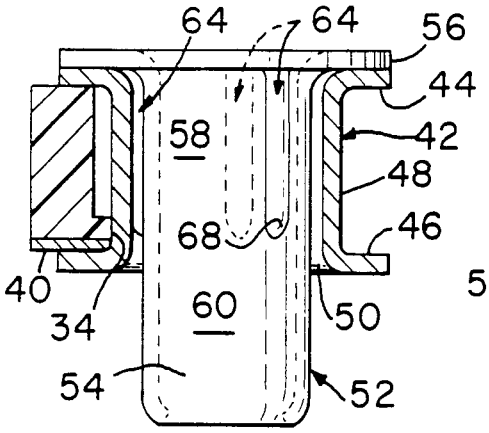
FIG. 4 is a partial cross-section of a mounting flange showing an alternate embodiment shoulder eyelet disposed in a coaxial eyelet.
Figure 5:
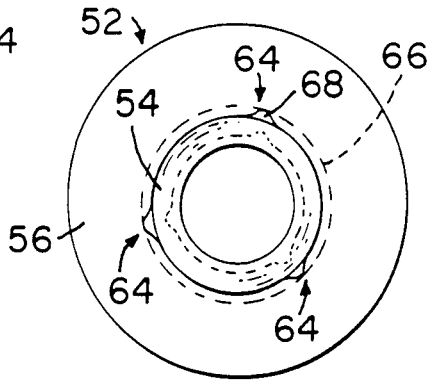
FIG. 5 is a bottom end view of the shoulder eyelet of FIG. 5.

FIG. 4 shows an alternate embodiment of rivet 52 disposed in eyelet 42 with FIG. 5 being a bottom view of the alternate embodiment of rivet 52. In the alternate embodiment, rivet 52 has a shank 54 of substantially constant diameter to be received in holes 36 of printed circuit board 36. First section 58 has ribs 64 that provide a greater effective diameter 66 than the diameter of shank 54 and provide an interference fit between rivet 52 and eyelet 42. Ribs 64 typically do not extend beyond eyelet 42 so as not to interfere with mounting housing 12 on printed circuit board 26.

Ribs 64, in a preferred alternate embodiment, are parallel to the axis of shank 54. As shown, three ribs equidistantly spaced around the perimeter of shank 54 serve to center rivet 52 in eyelet 42 with tapered lead-in surfaces 68 facilitating insertion into eyelet 42.

Figure 6:
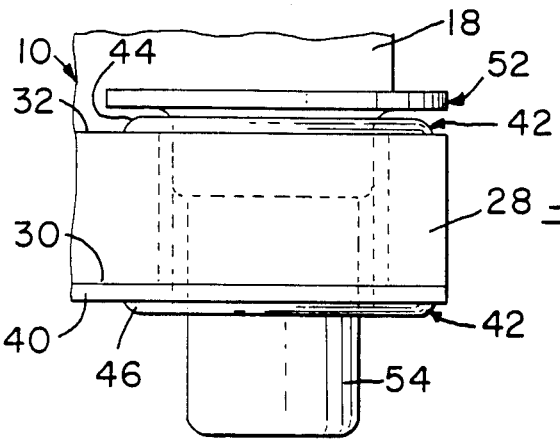
FIG. 6 is a partial end view of the connector assembly.

FIG. 6 shows an eyelet 42 securing ground strap 40 to mounting face 30 with a rivet 52 closely received in eyelet 42. Eyelet 42 and rivet 52 thus become an integral part of the ground path.

Figure 7:
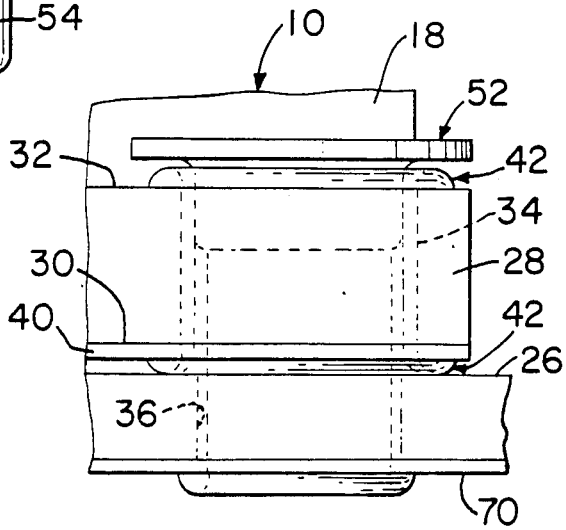
FIG. 7 is a partial end view of the connector assembly secured to a printed circuit board.

FIG. 7 shows a mounting flange as described above secured to printed circuit board 26 by rivet 52, such as by rivet 52 being flange expanded in accordance with known practice. In this manner, ground strap 40 becomes electrically conductive with ground trace 70 thereby completing the common ground circuit between shield 38 and the circuitry on printed circuit board 26 simultaneously with housing 12 being secured to printed circuit board 26. Although not shown, rivet 52 could be wave soldered to secure housing 12 to printed circuit board 26.

An electrical connector has been disclosed which includes an eyelet received in an opening a mounting flange of the connector housing and a rivet is located in the eyelet which has a flange engaging an upper section of the eyelet, a first section frictionally secured within the eyelet and a second section extending below a bottom surface of the housing for disposition in a hole in a circuit board.

We claim:

1. An electrical connector assembly for mounting to a printed circuit board, comprising:

a dielectric housing having a first integral flange having mounting face, an opposed holding face and a hole extending therebetween;

an eyelet disposed in said hole, said eyelet having end flange means engaging the mounting face and holding face with a generally cylindrical shank extending therebetween; and a rivet disposed in the eyelet comprising flange means and a generally tubular shank, the generally tubular shank having a first section within the eyelet including means for providing an interference fit between the rivet and the eyelet and a second section extending beyond the eyelet for securing the assembly to the printed circuit board, whereby the housing, eyelet and rivet form an assembly for mounting in preformed holes in the printed circuit board.

2. An electrical connector assembly as recited in claim 1 further comprising a formed metal shield having a ground strap extending along the holding face, said ground strap having a hole therethrough aligned with the flange hole, said ground strap secured to the mounting face by the eyelet passing through the hole in the ground strap.

3. An electrical connector assembly as recited in claim 1 wherein the means for providing an interference fit comprises a plurality of ribs within the eyelet, said ribs spaced around the shank of the rivet to give a greater effective diameter to the generally tubular shank, thereby providing the interference fit between the ribs and the eyelet.

4. An electrical connector assembly as recited in claim 1 wherein the means for providing an interference fit comprises the first section of the generally tubular shank having a diameter that results in an interference fit between the first section and the eyelet.

5. An electrical connector assembly as recited in claim 4 wherein the diameter of the second section is less than the diameter of the first section.

6. An electrical connector assembly as recited in claim 1 further comprising a second flange integral with said housing, said second flange having a mounting face coplanar with the mounting face of the first flange, and having a hole therethrough with a like eyelet and rivet therein.

7. An electrical connector assembly as recited in claim 6 further comprising a formed metal shield having a ground strap extending along the mounting face of each flange, said ground straps each having a hole therethrough aligned with respective flange holes, said ground straps secured to respective mounting faces by the respective eyelets passing through the holes in the ground strap.

* * * * *